US006364008B1

(12) United States Patent
Mannoni et al.

(10) Patent No.: US 6,364,008 B1
(45) Date of Patent: Apr. 2, 2002

(54) HEAT EXCHANGER WITH TUBE PLATES

(75) Inventors: Alberto Mannoni, Turin; Maurizio Parrino, Montaldo Torinese; Enrico Simonato, Turin, all of (IT); Anthony Joseph Cesaroni, Unionville (CA); Myron Bruce Babcock, Oakville (CA); Shailesh Ratilal Doshi, Kingston (CA); Gordon James Clarke, Markham (CA); Mahender Kumar Khurana; Kenneth Earl Stevens, both of Kingston (CA)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/467,167

(22) Filed: Dec. 20, 1999

Related U.S. Application Data

(60) Provisional application No. 60/116,874, filed on Jan. 22, 1999, and provisional application No. 60/122,686, filed on Mar. 3, 1999.

(51) Int. Cl.[7] ..... F28F 1/10

(52) U.S. Cl. ..... 165/172; 165/171; 165/910

(58) Field of Search ..... 165/171, 172, 165/910

(56) References Cited

U.S. PATENT DOCUMENTS

| | | | | |
|---|---|---|---|---|
| 3,648,768 A | | 3/1972 | Schöll | 165/171 |
| 4,475,586 A | * | 10/1984 | Grieb et al. | 165/172 X |
| 4,740,344 A | | 4/1988 | Wollbeck et al. | 264/248 |
| 4,771,825 A | * | 9/1988 | Chen et al. | 165/172 X |
| 5,195,240 A | | 3/1993 | Shuster et al. | |
| 5,469,915 A | | 11/1995 | Cesaroni | |

* cited by examiner

*Primary Examiner*—Leonard Leo
(74) *Attorney, Agent, or Firm*—Richard H. Burgess

(57) ABSTRACT

A heat exchanger comprising plates of thermoplastic tubes arranged in a way which minimizes the thermal resistance at the outer surface of the tubes preferably to not more than 5 times the resistance to heat transfer at the inside of the tubes. The tubes are arranged in the tube plates in groups that can be flat or slightly wavy, such as undulating in a periodic manner, or offset with open spaces facing groups of tubes in alternating rows. This is done in a way that maximizes turbulence outside the tubes and minimizes vortices which can trap coolant in the interstices between tubes.

9 Claims, 3 Drawing Sheets

HEAT EXCHANGER WITH TUBE PLATES

This application claims benefit of provisional application Ser. No. 60/116,874, filed Jan. 22, 1999, and also provisional application Ser. No. 60/122,686 filed Mar. 3, 1999.

BACKGROUND OF THE INVENTION

Thermoplastic heat exchangers have been made for some time. Efficient plate type units (panels) used in nylon heat exchangers are produced by a twin sheet thermoforming process with internal gas assist, which gives an essentially flat plate consisting of a number of tubes joined by ligatures formed from the sheets of nylon. This process is described in U.S. Pat. No. 5,195,240.

Such plates and the heat exchangers formed from them provide excellent heat transfer efficiency for the space and volume occupied, but can tolerate only relatively low internal pressures, restricting their applicability. Tubing formed by extrusion can tolerate much higher internal pressure. In a high efficiency exchanger a large number of small tubes are required and constraint and support of these tubes is needed. Use of tubing located between two bonded sheets of plastic to achieve this support is described in U.S. Pat. No. 5,469,915. However, this still requires ligatures between the tubes, which reduces heat transfer efficiency. The above-mentioned patents are incorporated herein by reference.

When one tries to bond groups of tubes together without ligatures between the tubes to hold them together, the efficiency of heat transfer from a primary heat transfer fluid inside the tubes to a secondary heat transfer fluid outside the tubes along with the technological process to bond tubes together are factors that can influence the commercial acceptability of the heat exchanger and thus its success or failure at the market place. The arrangement of the tubes in the tube plates can have a significant effect of the flow of coolant outside the tubes.

SUMMARY OF THE INVENTION

The present invention provides a heat exchanger comprising thermoplastic tubes having outside and inside surfaces within which tubes flows primary heat transfer fluid and outside of which tubes flows secondary heat transfer fluid, said tubes being adhered together in groups of at least four tubes each, each group having two faces, said groups being arranged in plates of from one to fifty groups, and a multiplicity of said plates being arranged in parallel rows with openings between the rows to permit flow of secondary heat transfer fluid along or across said faces, said faces being configured to minimize laminar flow, to increase turbulent flow of said secondary fluid as it passes over said plates, and to minimize the formation of vortices, with the tubes being arranged either in discontinuous groups within each plate or in a continuous or discontinuous wavy shape with each pair of tubes in each group being at an angle to the adjacent pair of tubes in the same group, measured by connecting lines between the centers of adjacent tubes, between 5 and 30 degrees and with the cumulative angle increasing from tube to tube for at least four tubes, then reversing.

The thermal resistance from the outside of the tubes to the secondary coolant can be less than five times, preferably less than three times, the thermal resistance from the primary coolant to the inside of the tubes.

DETAILED DESCRIPTION

Figure 1:
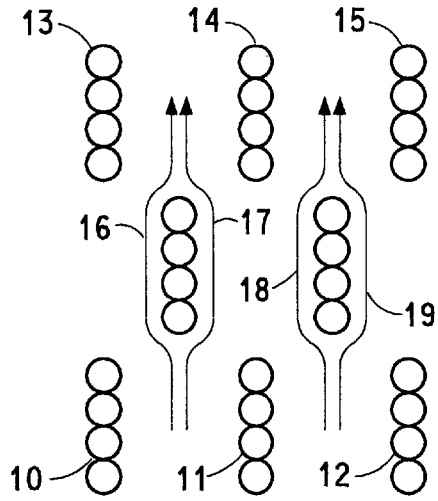
FIG. 1 is a schematic illustration of one embodiment of the invention with groups of tubes in alternating rows being spaced apart, with open areas adjacent areas of tubes in alternating rows.

In efforts to replace tube panels formed from film or sheet with channels made by molding assisted by gas pressure and also to replace tube panels with ligatures between the tubes to hold them together, whatever means are used to hold the tubes directly together, it has been found that the efficiency of heat transfer from the outside surface of the tubes to the secondary heat transfer fluid circulating outside the tubes, especially a gaseous secondary fluid such as air, tends to be much less than the efficiency from the primary heat transfer fluid inside the tubes to the inner walls of the tubes and through such walls to the outside surface. This has been found to be true in various configurations of thermoplastic heat exchangers themselves. It has also been found to be true in comparing thermoplastic tube heat exchangers with aluminum heat exchangers in classical heat transfer analyses. With metal heat exchangers, this effect can more easily be alleviated, such as by providing heat-conducting fins of the same metal, especially aluminum. With plastic heat exchangers, this approach does not work well. First, fins are more difficult to provide; second, plastic fins would not conduct heat well enough to be useful; third—joining dissimilar materials such as putting aluminum fins on nylon tubes, cannot readily be done.

To illustrate the difficulties of heat transfer at the surface of a tube-based nylon exchanger, in a radiator design with hot coolant liquid fluid inside the tubes and relatively cold gas such as air flowing outside the tubes, comparing a nylon heat exchanger with an aluminum heat exchanger, it has been found that the thermal resistance on the inside or the hot side is 5.1% in the nylon heat exchanger versus 51.5% for the aluminum exchanger, while the cold side thermal resistance for the nylon exchanger is 91.9% versus 48.4% for the aluminum exchanger. This shows the need to take steps to lower the cold side resistance of the nylon exchanger.

These measurements and calculations are based on routine engineering techniques described by Kays & London in "Compact Heat Exchangers", 3$^{rd}$ Ed., McGraw Hill (1984).

It is desirable to increase the turbulence of the secondary cooling fluid, that flowing around the outside of the tubes. At the same time, it is also desirable to minimize the formation of vortices or eddies of fluid in the vicinity of the interstices of the tubes. Similar to fluid flow effects in a river flowing around a rock, eddies can form where a volume is shielded from the flow, and the fluid in the eddies, although perhaps quite turbulent within the eddy, can be restricted to the area of the eddy.

The present invention accomplishes these superficially contrary goals by offsetting the tubes in relatively smooth wavy plates and/or in discontinuous groups of tubes in plates, such that the secondary fluid is caused to flow in curved lines, creating turbulence, while keeping most of the surface of the tubes accessible to the tubes with a minimum of eddy formation.

Various thermoplastic polymers can be used for the tubes and for barrier layers to be used in the tubes, such as the following:

"Zytel" FN 727 partially-grafted flexible nylon, produced by DuPont, is a blend by weight of 40% nylon 6; 46% "Surlyn"9320 ionomer produced by DuPont; 10% "EBAGMA" EP4934-6 compatibilizer produced by DuPont; 2% zinc stearate; and 2% "Irgonox" 1010 hindered phenolic antioxidant produced by Ciba Specialty Chemicals. It is in U.S. Pat. No. 5,091,478—Saltman et al., incorporated by reference.

"CFE8005" polyolefinic toughener, produced by DuPont, can be made as a blend by weight of 75.8% nylon 6,6; the functional equivalent of 17.2% Fusabond MF416D EP rubber, grafted with maleic annhydride, compatibilizer produced by DuPont; 4.4% carbon black 40% concentrate in nylon 6; "DER 732" diepoxy ethylene oligomer with a MW of about 300 produced by Dow Chemical; and 1500 ppm sodium hypophosphite. It is in U.S. Pat. No. 4,174,358—Epstein.

More broadly stated, polymers useful in the present invention include both isotropic thermoplastic polymers (ITP) and liquid crystal polymers (LCP), which include the following:

While the invention is illustrated with certain polyamides, it will be apparent that it is not limited to the use of such materials and that other thermoplastics, preferably ITPs can be used alternatively and can be used in combination with LCPs in various structures including multilayer films, such as the following: Isotropic herein means that the polymer is isotropic when tested by the TOT test described in U.S. Pat. No. 4,118,372, which is hereby included by reference. Any ITP may be used so long as it meets certain requirements. It must of course withstand the temperatures to which the heat exchanger is subjected and should throughout that temperature range provide sufficient strength (together with the LCP) to the heat exchanger to reasonably maintain its shape and contain the fluids in the heat exchanger, as needed. If it is exposed to one or more of the fluids in the heat exchanger (or any other adventitious materials that may contact it) it should be preferably reasonably chemically stable to those fluids so as to maintain its integrity.

Although various types of heat exchangers made simply of ITPs have been described, some ITPs can have drawbacks when the are the only materials in heat exchangers, depending on the uses to which the heat exchanger will be put. Sometimes an ITP may not be chemically stable to one or more of the fluids in the heat exchanger, for instance, many polyesters hydrolyze or otherwise degrade in the presence of water, water-alcohol, or water-glycol mixtures, especially at higher than ambient temperatures. Many ITPs are relatively permeable to many liquids and/or gases, and therefore allow losses and/or migration of these materials in or from the heat exchanger. Some ITPs may be swollen by one or more of the fluids used in the heat exchanger thereby changing their dimensions and/or physical properties. All of the above are of course problems in plastic heat exchangers.

It has been found that a layer of a thermotropic liquid crystalline polymer (LCP) used in the heat exchanger often alleviates or eliminates one or more of the above mentioned problems. By an LCP is meant a polymer that is anisotropic when tested in the TOT Test described in U.S. Pat. No. 4,118,372. If the LCP layer is placed between a fluid and any particular ITP in the heat exchanger it usually protects that ITP from chemical degradation by the fluid, and/or also often protects the ITP from being swollen by that fluid. In addition, even if the ITP is swollen, the LCP because of its high relative stiffness, and the fact that it is not swollen by many fluids, help the overall heat exchanger maintain its shape and dimensions. Also, the LCP acts as an excellent barrier layer to many fluids. For instance, in automotive heat exchangers which help cool the engine, the commonly used internal coolant is a mixture of a glycol and water, and the external coolant is air. With many ITPs diffusion of water and/or glycol is so rapid that frequent replenishment of the water/glycol mixture is needed. If an LCP layer is included, the diffusion is greatly decreased.

In order to obtain rapid heat transfer through the heat exchanger, thickness through the material between the heat transfer fluids should be a small as possible. This would be true with any material used for an heat exchanger, but is especially important with plastics since their heat transfer coefficients are usually relatively low when compared to metals. Since the LCP is usually the more expensive of the polymers present in the heat exchanger, it is economically preferable to limit its use. Therefore, in most constructions it is preferred that the LCP is present in relatively thin layer(s) and that layer(s) of the ITP be relatively thick so as to carry much of the structural load of the heat exchanger (i.e., pressure of the fluid(s), maintain structural shape and dimensions, etc.).

The heat exchanger is made up of one or more LCP layers and one or more layers of ITP. If more than one layer of LCP or ITP is present, more than one type of LCP or ITP, respectively, can be used. In addition other layers may be present. For example, so-called tie layers, also called adhesive layers, may be used to increase the adhesion between various LCP and ITP layers, or between ITP layers or between LCP layers. The number and placement of the various layers in the heat exchanger will vary depending on the particular polymers chosen, the fluids used in or by the heat exchanger, temperature requirements, environmental needs, etc.

Most commonly, tie layers and LCP layers will be relatively thin compared to the ITP layer(s). Typical constructions are given below, wherein Fluids 1 and 2 represent the fluids involved in the heat transfer:

(a) Fluid 1/LCP/ITP/Fluid 2
(b) Fluid 1/ITP-1/LCP/ITP-2/Fluid 2
(c) Fluid 1/LCP-1/ITP/LCP-2/Fluid 2
(d) Fluid 1/ITP-1/LCP-1/ITP-2/LCP-2/Fluid 2
(e) Fluid 1/ITP-1/ITP-2/LCP/Fluid 2
(f) Fluid 1/LCP-1/ITP-1/ITP-2/LCP-2/Fluid 2

In all of the above constructions, tie layers may be present between all, some or none of the various polymer layers.

Some of the above constructions may be particularly useful in certain situations. If Fluid 1 but not Fluid 2 chemically attacked the ITP, construction (a) may be particularly useful, but (c) and (f) may also be utilized. If both Fluids 1 and 2 attacked the ITP present construction (c) or (f) may be particularly useful. If one wanted to minimize diffusion of one fluid to another, a construction having two LCP layers, such as (c), (d) or (f) could be chosen. If a special surface is required to reduce abrasive damage on the Fluid 1 side, but great stiffness is also required from the ITP, a construction such as (e) could be chosen wherein ITP-1 and ITP-2 have the requisite properties. These and other combinations of layers having the correct properties for various applications will be obvious to the artisan.

Useful LCPs include those described in U.S. Pat. Nos. 3,991,013, 3,991,014 4,011,199, 4,048,148, 4,075,262, 4,083,829, 4,118,372, 4,122,070, 4,130,545, 4,153,779, 4,159,365, 4,161,470, 4,169,933, 4,184,996, 4,189,549, 4,219,461, 4,232,143, 4,232,144, 4,245,082, 4,256,624, 4,269,965, 4,272,625, 4,370,466, 4,383,105, 4,447,592, 4,522,974, 4,617,369, 4,664,972, 4,684,712, 4,727,129, 4,727,131, 4,728,714, 4,749,769, 4,762,907, 4,778,927, 4,816,555, 4,849,499, 4,851,496, 4,851,497, 4,857,626, 4,864,013, 4,868,278, 4,882,410, 4,923,947, 4,999,416, 5,015,721, 5,015,722, 5,025,082, 5,086,158, 5,102,935, 5,110,896, and 5,143,956, and European Patent Application 356,226. Useful thermotropic LCPs include polyesters, poly (ester-amides), poly(ester-imides), and polyazomethines. Especially useful are LCPs that are polyesters or poly(ester-amides). It is also preferred in these polyesters or poly(ester-amides) that at least about 50 percent, more preferably at least about 75 percent, of the bonds to ester or amide groups, i.e., the free bonds of —C(O)O— and —C(O)NR1— wherein R1 is hydrogen or hydrocarbyl, be to carbon atoms which are part of aromatic rings. Included within the definition herein of an LCP is a blend of 2 or more LCPs or a blend of an LCP with one or more ITPs wherein the LCP is the continuous phase.

Useful ITPs are those that have the requisite properties as described above, and include: polyolefins such as polyethylene and polypropylene; polyesters such as poly(ethylene terephthalate, poly(butylene terephthalate), poly(ethylene 2,6-napthalate), and a polyester from 2,2-bis(4-hydroxyphenyl)propane and a combination of isophthalic and terephthalic acids; styrenics such as polystyrene and copolymers of styrene with (meth)acrylic esters; acrylonitrile-butadiene-styrene thermoplastics; (meth) acrylic polymers including homo- and copolymers of the parent acids, and/or their esters and/or amides; polyacetals such as polymethylene oxide; fully and partially fluoropolymers such as polytetrafluoroethylene, polychlorotrifluoroethylene, poly(tetrafluoroethylene/hexafluoropropylene) copolymers, poly[tetrafluoroethylene/perfluoro(propyl vinyl ether)] copolymers, poly(vinyl fluoride), poly(vinylidene fluoride), and poly(vinyl fluoride/ethylene) copolymers; ionomers such as an ionomer of an ethylene-acrylic acid copolymer; polycarbonates; poly (amide-imides); poly(ester-carbonates); poly(imide-ethers); polymethylpentene; linear polyolefins such as polypropylene; poly(etherketoneketone); polyimides; poly(phenylene sulfide); polymers of cyclic olefins; poly(vinylidene chloride); polysulfones; poly(ether-sulfones); and polyamides such as nylon-6,6 nylon-6, nylon-6,12, nylon-6,12, nylon 4,6, and the polyamides from terephthalic acid and/or isophthalic acid and 1,6-hexanediamine and/or 2-methyl-1, 5-pentanediamine. Polyamides are preferred ITPs and preferred amides are nylon-6,6, nylon-6, and a copolymer of terephthalic acid with 1,6-hexandiamine and 2-methyl-1,5-pentanediamine wherein 1,6-hexanediamine is about 30 to about 70 mole percent of the total diamine used to prepare the polymer. Especially preferred polyamides are nylon-6,6, nylon-6 and a copolymer of terephthalic acid with 1,6-hexandiamine and 2-methyl-1,5-pentanediamine wherein 1,6-hexanediamine is about 50 mole percent of the total diamine used to prepare the polymer. Included within the definition of ITP herein are blends of 2 or more ITPs or blends of one or more ITPs with an LCP provided that the ITP(s) is the continuous phase.

One or more (if present) of the ITPs may be toughened. Toughening is known in the art, and may be accomplished by adding one or more or a rubber, functionalized rubber, resin which reacts with the ITP such as an epoxy resin, or other materials. Toughened polyamides are preferred.

The polymers may contain other materials conventionally found in polymers, such as fillers, reinforcing agents, antioxidants, antiozonants, dyes, pigments, etc. An especially useful material is a filler with high heat conductivity, which may increase the efficiency of the heat exchanger.

The composition of a tie layer will depend on which two polymers are on either side of it. For instance the tie layer may be an ITP functionalized or grafted to provide adhesion between the ITP and LCP layers, or may be a blend of one or more ITPs and one or more LCPs.

Typical thicknesses for ITP layers will range from about 0.025 to about 0.25 mm. Typical thicknesses for LCP layers will be about 0.01 to about 0.1 mm. Tie layers will usually be as thin as possible, consistent with their providing adhesion between polymer layers. This is usually about 0.01 to about 0.1 mm. The total thickness of the structure is preferably less than about 0.7 mm, more preferably about 0.12 to about 0.5 mm, and especially preferably about 0.15 mm to about 0.4 mm.

The tubes can be of any diameter and wall thickness, consistent with the need to transfer heat. Typical wall thicknesses are 0.005–0.015 in. (0.13–0.38 mm). In general, a minimum inner diameter of 0.030–0.060 in. (0.76–1.5 mm) is necessary to avoid pluggage in use. The outer diameter is determined by the internal pressure needs of the tube, generally up to 0.150–0.250 in. (3.8–6.4 mm).

EXAMPLES

To increase the turbulence of the secondary heat transfer fluid around the outside of the tube plates, discontinuous plates with open spaces between plates in a plane and the open spaces facing the plates in alternating rows, as in FIG. 1, can give improved results. Each plate is made up of groups of tube bundles 10–15. As illustrated, groups 10 and 13 are part of a first plate, group 16 is part of a second plate, and groups 11 and 14 are parts of a third plate. Groups 10 and 13 are spaced apart, and group 16 is adjacent the thus-created open space in the first plate. This causes coolant flows 16–19 to move back and forth, creating turbulence. With the plates flat, as illustrated, the formation of vortices or eddies is minimized.

Figure 2:
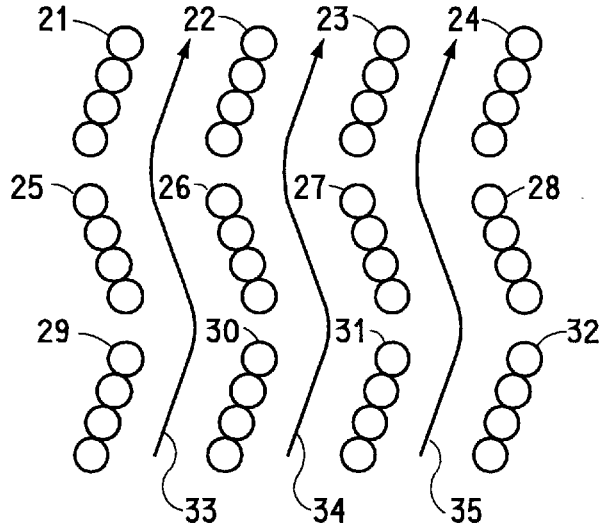
FIG. 2 is a schematic illustration of another embodiment of the invention with discontinuous plates of tube spaced apart and arranged in wavy rows.

Likewise, the geometry of tubes in tube panels in FIGS. 2 also can give improved results. In this case, groups of tubes in each panel 21–24, 25–28, and 29–32 are offset, and coolant flows 33–35 are caused to curve and become turbulent. The angle between tube groups is no more than 30 degrees, preferably no more than 15 degrees.

Figure 3:
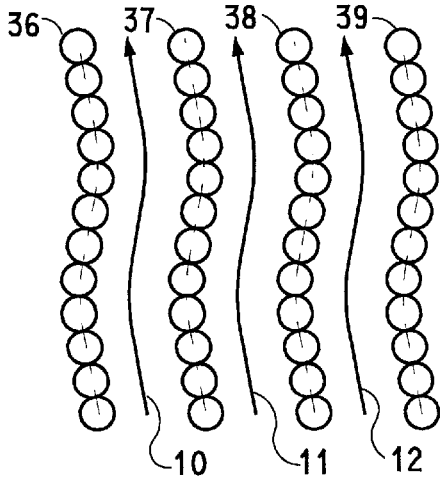
FIG. 3 is still another embodiment of the invention with continuous tube plates arranged in wavy rows.

In FIG. 3, the tube panels 36–39 are continuous rather than separated into groups, and the panels are curved, causing the coolant flow to curve again. The curve of the panels is smooth to minimize formation of eddies. If one draws a series of straight lines connecting the centers of the tubes, the angles between are at least 5 degrees and no more than 30 degrees, preferably no more than 15 degrees. Periodically, after at least four tubes, the direction of the angles is reversed, to form a wavy panel. This defines the smoothness of the curve of the panels, so as to minimize formation of eddies.

Figure 6:
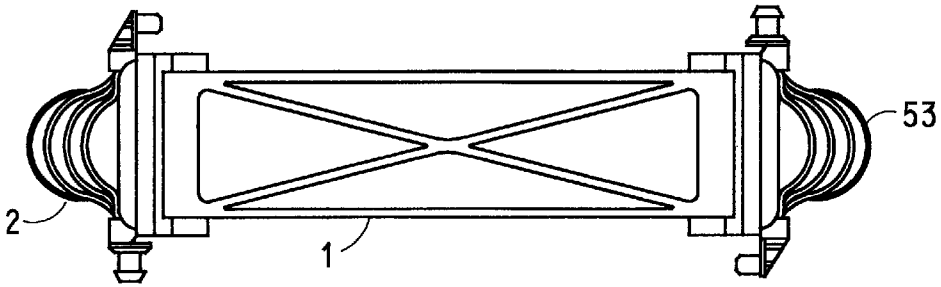
FIGS. 4–6 are schematic illustration of a heat exchanger of the invention.
Figure 4:
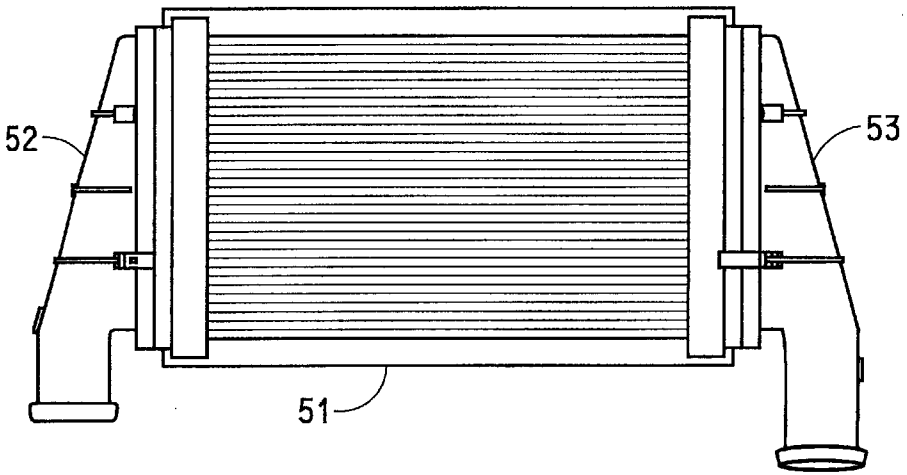
Figure 5:
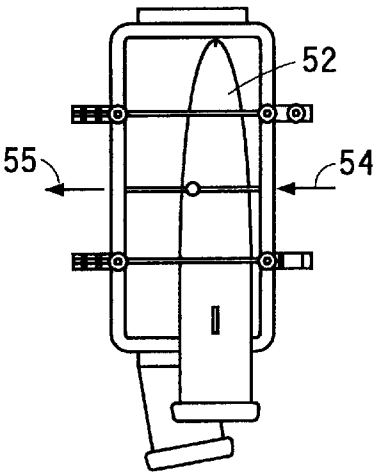

In FIGS. 4, 5 and 6, the heat exchanger of the invention has a stack of tube panels of the invention at 51, inlet and outlet headers at 52 and 53, and a flow direction of secondary coolant of 54 to 55. As is known in the art, primary coolant can be provided in through one of headers 52 and 53 and out through the other. The heat exchanger illustrated is suited to be a charge air cooler, with hotter gas inside and colder gas outside the tubes.

Figure 7:
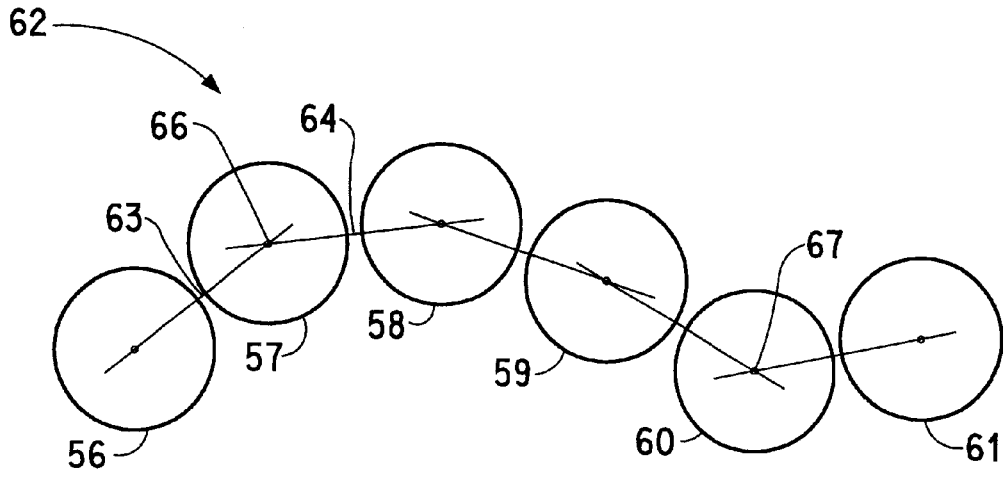
FIG. 7 is a schematic representation of a wavy plate of tubes, illustrating how to measure the angles between pairs of tubes.

FIG. 7 illustrates how the angle is measured between a line drawn from the center of one tube to the center of the next tube and the next line drawn from the center of that next tube to the center of the second next tube, and so forth. A wavy plate of tubes 62 is made up of tubes 56 through 61, with the angle increasing from tube pairs 56–57, to tube pairs 57–58, with the cumulative angle continuing to increase to tube pairs 58–59, then reversing to tube pairs 59–60 and continuing to tube pairs 60–61. Since the angle can be in the range of 5 to 30 degrees, this defines the degree of waviness of the plate. The curve can continue for a greater number of tube pairs than four. The maximum number of tube pairs before the curve reverses depends on the angle, so that the tube plate continues in a generally wavy plate rather than curving back in on itself.

What is claimed is:

1. A heat exchanger comprising thermoplastic tubes having outside and inside surfaces within which tubes flows primary heat transfer fluid and outside of which tubes flows secondary heat transfer fluid, said tubes being adhered together in groups of at least four pairs of tubes each, each group having two faces, and a multiplicity of said groups being arranged in parallel rows with openings between the rows to permit flow of secondary heat transfer fluid along or across said faces, said faces being configured to minimize laminar flow, to increase turbulent flow of said secondary fluid as it passes over said plates, and to minimize the formation of vortices, with the tubes in each group being arranged in a continuous wavy shape with each pair of tubes in each group being at an angle to the adjacent pair of tubes in the same group, measured by connecting lines between the centers of adjacent tubes, between 5 and 30 degrees and with the cumulative angle increasing from tube to tube for at least four pairs of tubes, then reversing.

2. The heat exchanger of claim 1 in which said groups have a wavy shape which is undulating in a periodic manner.

3. The heat exchanger of claim 2 in which the wavy shape is approximately sinusoidal.

4. The heat exchanger of claim 1 in which the tubes in a group are adhered to each other.

5. The heat exchanger of claim 1 having from 6 to 50 tubes in each group.

6. The heat exchanger of claim 1 wherein the thermoplastic is polyamide.

7. The heat exchanger of claim 1 wherein the thermal resistance from the outside of the tubes to the secondary heat transfer fluid is no more five times the thermal resistance from the primary heat transfer fluid to the inside of the tubes.

8. The heat exchanger of claim 7 wherein said thermal resistance is no more than two times.

9. The heat exchanger of claim 1 having from 2 to 500 rows.

* * * * *